United States Patent [19]

Fay

[11] Patent Number: 4,624,512

[45] Date of Patent: Nov. 25, 1986

[54] PROCESSING CABINET WITH SUB-DOOR ACCESS

[75] Inventor: John M. Fay, Warminster, Pa.

[73] Assignee: Hull Corporation, Hatboro, Pa.

[21] Appl. No.: 743,062

[22] Filed: Jun. 10, 1985

[51] Int. Cl.[4] ..... A47B 57/06

[52] U.S. Cl. ..... 312/292; 49/360; 312/312

[58] Field of Search ..... 49/360; 312/312, 291, 312/292

[56] References Cited

U.S. PATENT DOCUMENTS

| | | | |
|---|---|---|---|
| 2,136,558 | 11/1938 | Marshell | 312/292 |
| 4,345,802 | 8/1982 | Sorensen | 312/312 |
| 4,449,305 | 5/1984 | Baron et al. | 34/92 |
| 4,503,784 | 3/1985 | Turecek | 49/360 |

FOREIGN PATENT DOCUMENTS

| | | | |
|---|---|---|---|
| 291694 | 4/1915 | Fed. Rep. of Germany | 49/360 |
| 2625849 | 6/1975 | Fed. Rep. of Germany | 49/360 |

*Primary Examiner*—William E. Lyddane
*Assistant Examiner*—Joseph Falk
*Attorney, Agent, or Firm*—Olson and Olson

[57] ABSTRACT

The main door of a freeze dryer is provided with a sub-opening arranged to register with the space between adjacent vertically adjustable freeze dryer shelves, for infeeding and outfeeding trays or other containers of material to and from each shelf. An entry chamber surrounds the sub-opening and has a sloping outer face provided with a resilient seal arranged to form a pressure tight seal with a sub-door movable by a fluid pressure piston-cylinder unit between positions opening and closing the entry passageway of the entry chamber. Photoelectric safety mechanism is associated with the entry passageway to prevent closing of the sub-door when any object is in the entry passageway.

6 Claims, 3 Drawing Figures

PROCESSING CABINET WITH SUB-DOOR ACCESS

BACKGROUND OF THE INVENTION

This invention relates to specialized industrial chambers such as freeze dryers, and more particularly to a novel sub-door assembly arranged to facilitate process control and automation.

The trend in many industries today is toward automation and quality control. As an example, the pharmaceutical industry is becoming more interested in automation and process control particularly from the standpoint of maintaining sterility and temperature control during manufacture and packaging of its products. Large freeze dryers, typical in the art, are utilized in the processing of drugs and the like, and U.S. Pat. No. 4,449,305 is illustrative of a conventional freeze dryer having a plurality of adjustable shelves and provided with means to automatially transfer items from the shelves of one series to the shelves of another series.

One of the first steps toward achieving automated chamber loading is to provide some access into the chamber for the loading of the shelves other than by utilizing the large main door. Ideally, the object is to expose only enough area required to load one shelf at a time. This ensures the least amount of exposure to the inside of the chamber. If, for example, the shelves inside the chamber were at a very low temperature, opening the main door could allow the shelves to warm up due to their exposure to the higher external temperature. Additionally, it permits a larger area for any contaminants to enter the chamber. Opening and closing the large main door each time a shelf is to be loaded is wasteful, time consuming, not cost effective and interferes with loading and other automation mechanisms.

Ideally, therefore, it is desirable to facilitate the automatic loading of a chamber while reducing the impact of the outside environment on the interior during such operation. Consequently, it is advantageous that a loading opening be configured to expose only enough area required to allow passage therethrough of material to be loaded onto each shelf one at a time. This allows systematic shelf loading, shelf by shelf, as each is sequentially raised to a prescribed receiving position at the opening. A sub-door would be arranged to automatically open and close the opening at appropriate times during the loading and unloading operation.

Although there is a demonstrated need for a sub-door assembly which is arranged to cooperate with automated and semi-automated loading systems such as has been described, none has heretofore been available.

SUMMARY OF THE INVENTION

In its basic concept, this invention provides a sub-door for a specialized chamber such as a freeze dryer, the sub-door arranged to open and close a relatively small opening in the main door of the chamber whereby to permit sequential loading and unloading of shelves within the chamber.

It is by virtue of the foregoing basic concept that the principal objective of this invention is achieved: namely, provision of a sub-door which is arranged to permit access to an interior chamber while minimizing the exposure of such interior to the outside environment during loading and unloading.

Another object of this invention is the provision of a chamber sub-door of the class described which facilitates automated loading and unloading operations and significantly reduces the time required therefor.

Another object of this invention is the provision of a chamber sub-door of the class described which may be operated in conjunction with a programmed movement of shelves disposed within the chamber so that as each shelf is moved automatically to a prescribed position in registry with the sub-door opening, the sub-door will open and permit passage of material to be processed therethrough to and from the shelf, whereby systematic shelf loading and unloading, shelf by shelf, may be accomplished completely automatically.

A further object of this invention is the provision of a door of the class described which forms a sub-door in the main door of a freeze dryer or similar cabinet, to enable access to the interior of the cabinet without the necessity of opening the main door.

Yet another object of this invention is the provision of a chamber sub-door of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

A freeze dryer, as well as other generally similar types of commercial/industrial speciality cabinets, utilizes an interior space defined by closure walls, illustrated by bottom wall 10 and a hinged main door 12 through which access to the interior is normally gained. Typically, a plurality of movable shelves 14 are disposed within the dryer and arranged to receive trays or other types of containers (not shown) containing material to be processed in the dryer. Normally, the main door 12 is opened to load or unload the trays of material. For the purposes of this invention, the main door 12 of the cabinet will be considered herein as closing the interior of a freeze dryer, typical in the pharmaceutical industry, by a plurality of clamp bolts 12'. It is to be understood however, that the present invention is not limited in its application to use solely in association with such specific structures.

Of particular importance in the pharmaceutical industry is the need to maintain a high level of sterility and constant temperature in the cabinet. Clearly, when opening the large door 12 to load or unload, these aspects are completely lost to the effects of the outside environment. It is desirable to minimize the exposure of the interior of the cabinet to the outside by reducing the duration of the opening as well as the size of the opening that is utilized to load and unload the chamber shelves 14.

Toward this end, the illustrated embodiment of the present invention provides an entry sub-opening 16 through the main door 12. The sub-opening preferably is dimensioned only large enough to permit passage of loaded trays or other containers therethrough. This dimension also is about equal to the maximum spacing between adjacent shelves 14. In the embodiment illustrated the vertical height of the opening 16 is about five inches and the maximum spacing between shelves 14 is about 4 inches. The width of the opening is about the same as the width of the shelves.

Means is provided to quickly and securely close the sub-opening when material is not being moved therethrough. This closing means comprises the sub-door mechanism now to be described.

Figure 2:
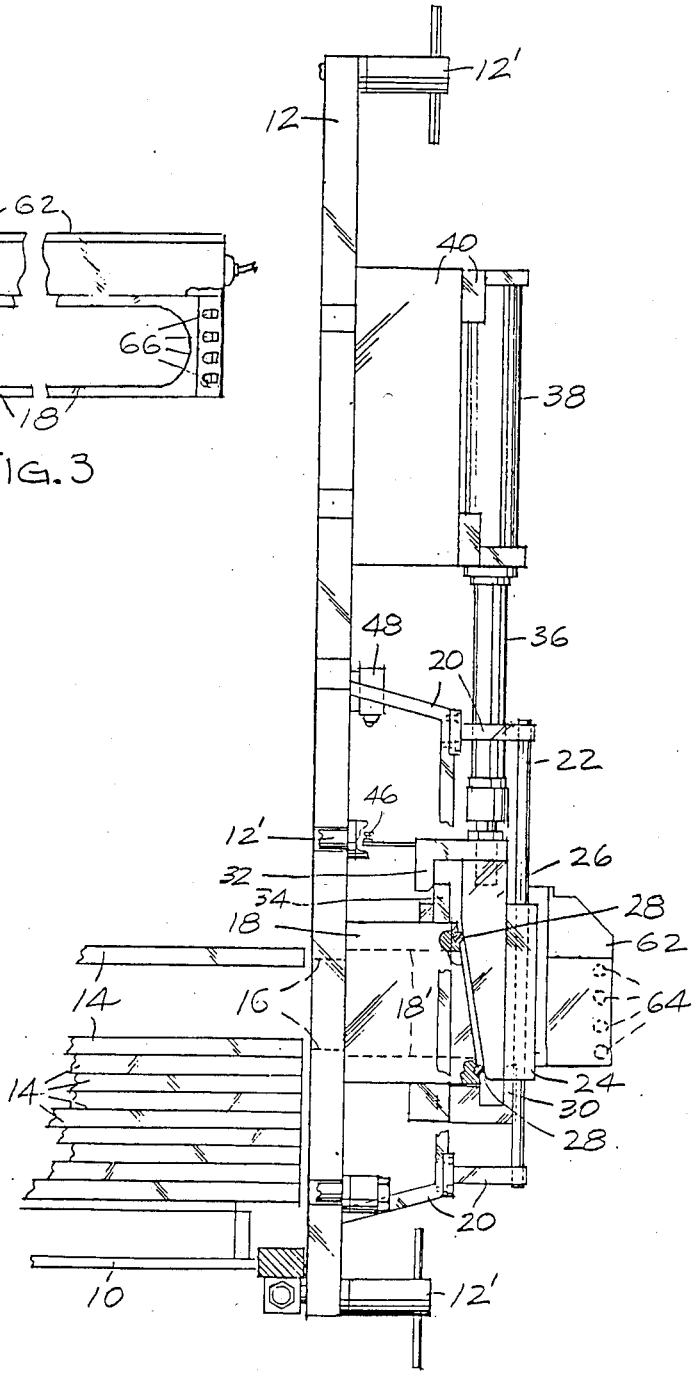
FIG. 2 is a fragmentary side elevation of the freeze dryer as viewed from the left in FIG. 1 showing a portion of the interior of the dryer, the main dryer door, and the sub-door apparatus mounted on the outside of the main door.

In the embodiment illustrated best in FIG. 2, the sub-door assembly of this invention is mounted to the outside surface of the main door 12. An entry chamber 18 is mounted on the main door encircling the entry sub-opening 16. It forms a passageway 18' which, when closed by a sub-door, is air and pressure tight and capable of maintaining the same environment as is in the interior of the cabinet during its operation.

A pair of mounting brackets 20 are anchored to the main door adjacent the lateral sides thereof and are configured to support sub-door guide means, such as guide rods 22. The rods provide tracks which receive guide sleeves 24 associated with a sub-door 26 now to be described.

Figure 1:
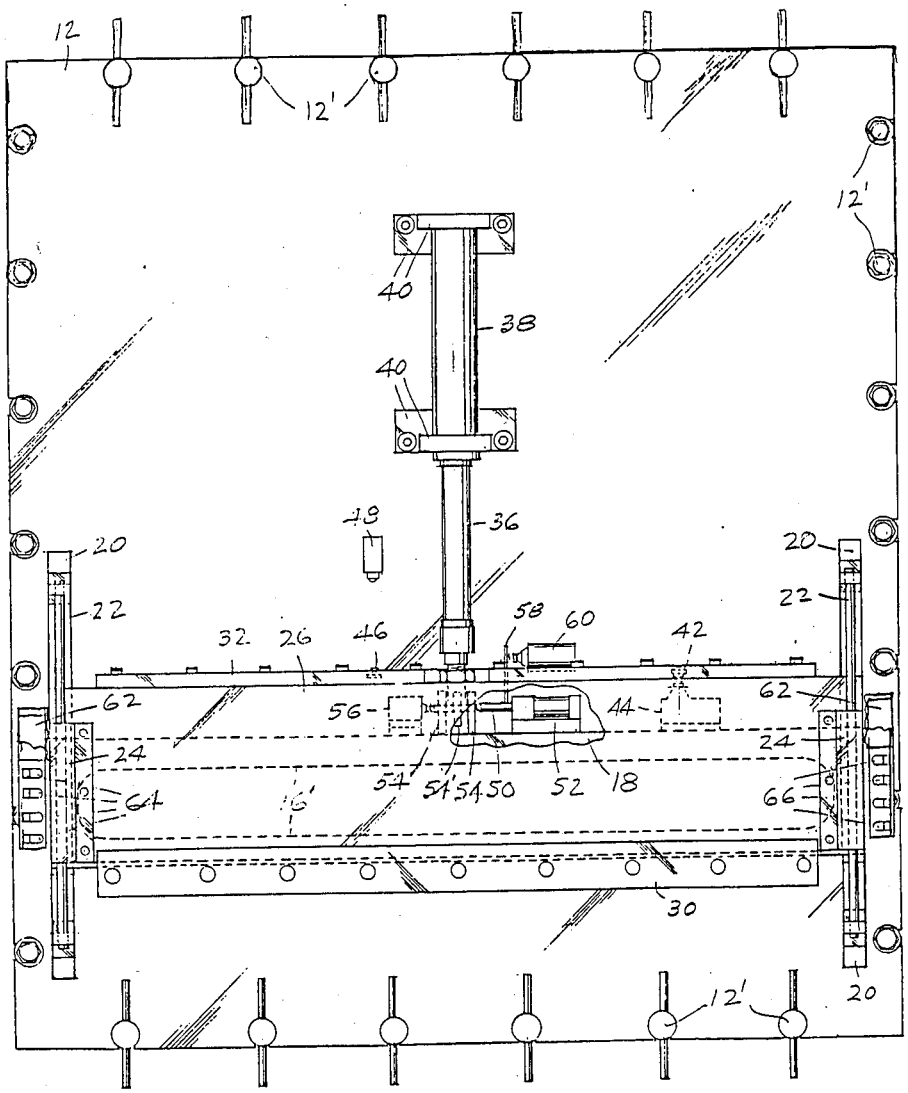
FIG. 1 is a fragmentary front elevation of a sub-door embodying the features of this invention mounted on the main door of a freeze dryer, parts being broken away and others shown in broken lines to illustrate internal detail.

The sub-door illustrated in FIGS. 1 and 2 provides means by which the opening 16 and entry chamber 18 may be releasably closed in order to isolate the interior of the cabinet from the outside environment. As shown, the sub-door is configured to extend across the entry chamber opening and the guide sleeves 24 are secured to the sub-door adjacent both sides thereof for sliding movement vertically along the guide rods 22.

The sub-door 26 and the outwardly facing open end of the entry chamber 18 are configured to meet with each other closely along their angularly sloping faces when the sub-door is in its lowered, closed position, as shown in FIG. 2. Further, seal ring 28 is mounted on the sloping face of the entry chamber 18 for abutment by the confronting, sloping face of the door 26 so that an air tight and pressure tight seal is formed therebetween.

The sub-door 26 is forced against the seal ring 28 and ultimately in metal-to-metal sealing engagement with the sloping face of the entry chamber 18 by the guide rods 22 and sleeve 24, reinforced by the guide 30 mounted on the frame 20 to receive the lower end of the sub-door as it moves to the closed position, and also by the reinforcing guide 32 which is secured to the upper end of the sub-door and arranged during closing of the sub-door to engage the reinforcing bar 34 mounted on the frame 20. FIG. 2 shows the sub-door slightly elevated from its fully closed and sealed position.

The sub-door 26 is secured to and reciprocated between open and closed positions by the piston rod 36 of cylinder 38 of a fluid pressure piston-cylinder unit, preferably hydraulic, which is mounted on the main door 12 by brackets 40. Other mechanical devices, such as a motor driven toggle mechanism, screw, or gear assembly, may be utilized in place of the cylinder unit.

When the sub-door 26 is closed, arm 42 on the guide 32 engages a microswitch 44 mounted on the entry chamber 18, and when the sub-door is opened, arm 46 on the guide 32 engages microswitch 48 on the main door 12. These microswitches 44 and 48 function to activate audible and/or visible signals to provide evidence of the condition of the sub-door. The microswitches also may be utilized to function as computer control to initiate the next step in the cycle of the operation, as discussed hereinafter.

The sub-door 26 is locked in the closed position by locking piston 50 which extends retractably from the locking cylinder 52 mounted on the entry chamber 18. The locking piston retractably enters openings in a pair of locking bars 54 mounted on the top side of the entry chamber 18, and a bar 54' mounted on sub-door 26. When locked, the extended locking piston 50 (broken lines in FIG. 1) engages microswitch 56 mounted on the entry chamber 18. The microswitch functions to activate an audible and/or visible signal to provide evidence that the sub-door is locked in its closed position.

In addition, or alternatively, the microswitch 56 may function as a computer control to activate the next step in the cycle of operation. For example, it may function to initiate the sequencing of the next shelf 14 into registry with the sub-opening 16, or to initiate the evacuation of the chamber in a freeze-drying process.

When the locking piston 50 is retracted from the locking bars 54 and 54' (full lines in FIG. 1), an arm 58 on the locking piston 50 engages microswitch 60 mounted on a main door 12. Microswitch 60 functions to activate an audible and/or visible signal to provide evidence that the sub-door 26 is in the unlocked condition. In the manner previously described, the microswitch 60 also function as a computer control to activate the next step in the cycle of operation, for example to open the sub-door 26 by activating the cylinder 38 to retract the piston 36. With the sub-door opened, a tray or other container of material being processed may be fed onto or removed from the shelf 14 registering with the sub-opening 16.

Figure 3:
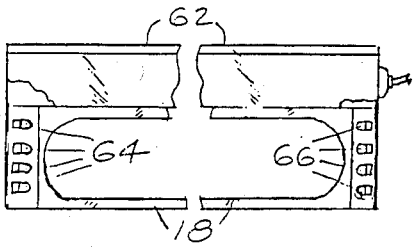
FIG. 3 is a foreshortened front elevation of a photocell safety mechanism mounted on the main door in registry with the sub-door opening and with the sub-door open.

To ensure against accidental injury to personnel, or damage to trays or other containers, material on the trays, and other objects present in the entry passageway 18' and which injury or damage could result from closure of the sub-door, safety mechanism preferably is provided to prevent the closing movement of the sub-door when any object is present in the entry passageway. In the embodiment best illustrated in FIG. 3, a photoelectric cell assembly is utilized. An inverted U-shaped housing 62 is mounted on the framework 20 in front of the entry chamber 18. A plurality of light sources 64 are mounted on one side portion of the housing 62 in vertically spaced arrangement to span the vertical height of the entry passageway 18'. A corresponding plurality of photoelectric light detectors 66 are mounted on the opposite side portion of the housing 62, each for detecting the light from a different one of the light sources 64. Accordingly, any object extended into the passageway 18' will interrupt at least one light source 64, and the sensing of this interruption by the associated detector 66 operates to prevent application of hydraulic pressure to cylinder 38 to move the sub-door 26 in the closing direction.

The operation of the assembly described hereinbefore is as follows: With the components of the assembly arranged as illustrated in the drawings, let it be assumed that it is desired to open the sub-door 26. This is achieved by actuating the hydraulic cylinder 38, either manually, semi-automatically, or fully automatically by computer control, to retract the piston rod 36 and elevate the sub-door 26 from its closed position across the front of the entry chamber 18.

When the sub-door reaches its fully open condition, arm 46 closes the microswitch 48 to activate a signal and/or a computer to initiate the next step in the cycle of operation. In this regard, opening of the sub-door exposes the entry passageway 18' and the sub-opening 16 to afford access to the interior of the cabinet, as for infeeding or outfeeding a tray or other container onto or from the shelf 14 registering with the sub-opening 16. Other trays or containers may be feed onto or removed from other shelves 14 by moving each shelf into registry with the sub-opening 16. Such movement of shelves may be effected manually, semi-automatically, or by computer control, as will be understood. Further, the manipulation of trays or other containers to and from the shelves may be done by hand or by robotic mechanisms, as desired.

To close the sub-door 26, hydraulic cylinder 38 is activated to extend its piston rod 36 and lower the sub-door to bring its sloping surface into pressure sealing contact with the seal ring 28 on the entry chamber 18. Arm 42 closes the microswitch 44 to signal the closure of the sub-door, whereupon the locking cylinder 52 is activated to extend its locking piston 50 through the registry openings in the locking bars 54 and 54' and then into activating contact with microswitch 56. Thereupon, heat or vacuum or other conditioning may be applied to the chamber, as required for the process.

From the foregoing it will be apparent that the present invention provides simplified and effective sub-door mechanism by which to access a processing cabinet with speed and facility while minimizing the exposure of the chamber interior to the outside environment. Moreover, such access and the process steps incident thereto may be effected manually, semi-automatically, or fully automatically by computer control. Still further, manipulation of materials to be processed in the cabinet may be done by hand, or by robotic mechanisms. Additionally, safety against injury to personnel or damage to equipment is insured by preventing closure of the sub-door whenever any object is present in the opening closed by the sub-door.

It will be apparent to those skilled in the art that various changes may be made in the size, shape, type, number and arrangement of parts described hereinbefore, with departing from the spirit of this invention and the scope of the appended claims.

Having now described my invention and the manner in which it may be used, I claim:

1. In combination, a cabinet having a main closure door, (a) an access sub-opening in the main door configured to permit access to the interior of the cabinet through the main door when the latter is closed, (b) an entry chamber mounted on the outside of the main door and surrounding the sub-opening, forming an entry passageway registering with the sub-opening and having a sloping outer face, (c) a sub-door mounted on and spaced outwardly from the main door for movement across the outer face of the entry chamber to open and close said sub-opening, (d) sealing means interposed between the entry chamber and sub-door and comprising a resilient seal surrounding said entry chamber sloping outer face, the sub-door having a sloping face arranged to abut the resilient seal and form a pressure tight seal therewith when the sub-door is in closed position, and (e) power means interengaging the main door and sub-door and operative to move the sub-door relative to the entry chamber to open and close the access sub-opening.

2. The combination of claim 1 wherein the cabinet houses a plurality of shelves movable vertically to position adjacent pairs of shelves at a spaced apart loading and unloading position, and the sub-opening is located in the main door for registration with said shelf loading and unloading position.

3. The combination of claim 2 wherein the sub opening in the main door is substantially the same height and width as the space between adjacent shelves at the loading and unloading position.

4. The combination of claim 1 wherein the power means comprises a fluid pressure piston-cylinder unit.

5. The combination of claim 1 including safety means mounted on the main door and registering with the entry passageway and operatively associated with the power means to prevent operation of said power means to move the sub-door to closed position when any object is present in the entry passageway.

6. The combination of claim 5 wherein the safety means comprises photoelectric light source and detector means spanning the space across the entry passageway.

* * * * *